United States Patent [19]

Reuss et al.

[11] Patent Number: 4,887,971

[45] Date of Patent: Dec. 19, 1989

[54] RE-SHIELDED COUPLING PART

[75] Inventors: Oswald Reuss, Unterelsbach; Franz Rutterschmidt, Heustreu, both of Fed. Rep. of Germany

[73] Assignee: Preh, Elektrofeinmechanische Werke Jacob Preh, Nachf, GmbH & Co., Bad Neustadt/Saale, Fed. Rep. of Germany

[21] Appl. No.: 269,612

[22] Filed: Nov. 10, 1988

[30] Foreign Application Priority Data

Nov. 19, 1987 [DE] Fed. Rep. of Germany ..... 8715349

[51] Int. Cl.[4] ..... H01R 13/648

[52] U.S. Cl. ..... 439/98; 439/610

[58] Field of Search ..... 439/98, 99, 610, 583

[56] References Cited

U.S. PATENT DOCUMENTS

| | | | |
|---|---|---|---|
| 2,870,420 | 1/1959 | Malek | 439/583 |
| 3,907,399 | 9/1975 | Spinner | 439/583 |
| 4,025,145 | 5/1977 | Shaffer et al. | 439/610 |
| 4,272,148 | 6/1981 | Knack, Jr. | 439/610 |
| 4,399,318 | 8/1983 | Waters | 439/610 |
| 4,493,525 | 1/1985 | Hall et al. . | |

FOREIGN PATENT DOCUMENTS

| | | | |
|---|---|---|---|
| 0125760 | 11/1984 | European Pat. Off. . | |
| 0163049 | 4/1985 | European Pat. Off. . | |
| 1037546 | 8/1958 | Fed. Rep. of Germany | 439/583 |
| 115450 | 9/1963 | Fed. Rep. of Germany | 439/583 |
| 1246077 | 8/1967 | Fed. Rep. of Germany | 439/607 |
| 8516000 | 10/1985 | Fed. Rep. of Germany . | |
| 1300612 | 6/1962 | France | 439/583 |
| 1307063 | 9/1962 | France | 439/583 |

*Primary Examiner*—Gary F. Paumen

*Attorney, Agent, or Firm*—Wegner & Bretschneider

[57] ABSTRACT

An RF-shielded coupling part of a cable having a shielding sheath within its jacket is provided, which can be firmly mounted to the cable in a simple and RF-tight way by using simple parts. For this purpose, a metallic stopper is firmly pushed onto the jacket, which surrounds the circumference of the jacket. The contact area of the shielding sheath is solderlessly clamped in between the stopper and a slotless shield. The shield is in a close relationship to the stopper at its entire circumference and is held to the stopper in a form-fit connection.

5 Claims, 1 Drawing Sheet

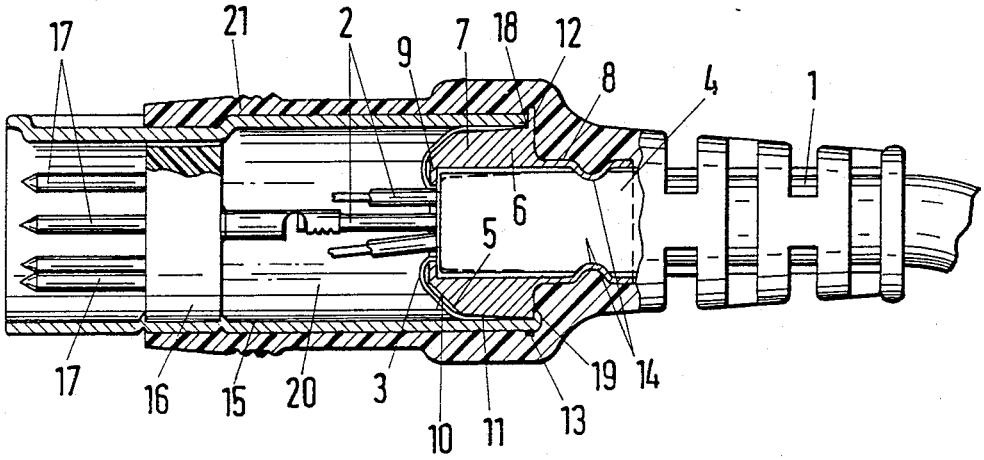
17
21
2
9
7
18
12
8
4
1
6
5
17
16
15
20
3
10
11
13
19
14

RE-SHIELDED COUPLING PART

BACKGROUND OF THE INVENTION

The invention relates to an RF-shielded coupling part for a cable, in particular a multiwire cable having a shielding sheath within its jacket; in a contact area stripped of the jacket, the cable is in an electrically conductive connection to a metallic shield. Cables of this type are used, for example, with data processing systems.

An undesirable aspect of such cables is that, with known coupling parts of cables used with data processing systems, radio frequency interferences are received or radiated.

SUMMARY OF THE INVENTION

It is a feature of the present invention to provide a coupling part of the type described above, which is RF-tight and can be firmly mounted to the cable in a simple way, using simple parts.

According to the invention, this feature is achieved in that a metallic stopper is pushed onto the jacket surrounding the circumference of the jacket and is secured in position in a direction longitudinal to the cable, in that the contact area is solderlessly clamped in between the stopper and either the jacket or the shield, and in that the stopper sits in a close relationship to the slotless shield in its entire circumference and the shield is held in a force-fit connection at the stopper in the longitudinal direction of the cable.

This construction prevents the formation of a radio frequency window between the cable and the shield, because the metallic stopper surrounds the jacket and is in turn enclosed by the shield. During assembly, when the stopper and the shield are pushed on, the contact area of the shielding sheath is simultaneously contacted. Even if the sheath in its contact area is shifted at the circumference. The shield is tightly direction of the cable.

Advantageous embodiments of the invention are explained in the following description of a non-limiting example.

BRIEF DESCRIPTION OF THE DRAWING

The FIGURE shows a sectional view of an RF-tight coupling part according to the invention.

DETAILED DESCRIPTION OF THE INVENTION

A cable 1 comprises a plurality of wire strands 2 and a shielding sheath surrounding the wire strands 2, which runs within a jacket 4. At the end of the cable, the jacket 4 has been removed, so that a contact area 5 of the shielding sheath 3 is exposed.

A stopper 6 consisting entirely of metal is pushed onto the jacket 4. The stopper 6 comprises a head portion 7 and a neck portion 8 turned away from the contact area 5. A collar 9 extending around the head portion 7 is formed, which is adjacent to the jacket 4 and over which the contact area 5 of the shielding sheath 3 is reversely drawn. The contact area 5 extends over a bevel 10 of the head portion 7 and is adjacent to a circumferential surface 11 which conically increases in diameter toward the neck portion 8. Connected to the circumferential surface 11, a web 12 projecting outward is provided at the head portion 7; the web 12 comprises a plurality of recesses 13 evenly distributed at its circumference.

When the stopper 6 is slipped onto the jacket 4 such that its collar 9 is stopped by the jacket 4, and, in doing so, presses the contact area 5 of the shielding sheath 3 to the cable 1 or close to the wire strands 2 of the cable 1, indentations 14 are made at the neck portion 8, which press into the jacket 4. This ensures a tight fit of the stopper 6 at the cable 1 in the longitudinal direction of the cable.

At the stopper 6, a slotless shield 15 is disposed, in which a carrier 16 for contact pins 17 is arranged. The shield 15 is of such type that it can be slipped and clamped onto the conical circumferential surface 11 of the head portion 7, with its entire circumference being in a close relationship to the head portion 7. At the same time, the reversed contact area 5 of the shielding sheath 3 is clamped between the shield 15 and the head portion 7. The edge 18 of the shield 15 communicates with the web 12. Lugs 19 project through the recesses 13. The lugs 19 are bent toward the head portion 7 after the shield 15 with its edge 18 has been pushed onto the head portion 7.

Like the stopper 6, the shield 15 consists of metal. Owing to the stopper 6 and the shield 15, which are in a solderless, electrically conductive connection to the contact area 5, the wire strands 2 are located in a space 20 which is RF-shielded with respect to the circumference and to the cable 1. Any RF-window between the jacket 4 and the plug socket 15 is avoided, because the shield 15 sits closely at the stopper 6 and because of the solid construction of the stopper 6 in the region of its head portion 7 and the extension of its neck portion 8 to a region of the cable 1 in which, by the exposure of the shielding sheath 3, the shielding sheath 3 is definitely not shifted. In the region of the head portion 7, displacement of the shielding sheath 3 in its contact area 5 is not detrimental, since, at any rate, the shield 15 is positioned close to the stopper 6.

A plastic sheath 21 is sprayed around the sheath 15 and the stopper 6. If necessary, the space 20 may also be filled by injecting a plastic mass.

For the connection between the sheath 15 and the stopper 6, these parts may also be provided with threads.

What is claimed is:

1. An RF-shielded coupling part for a multiwire cable having a shielding sheath within its jacket, in which the shielding sheath, in a contact area stripped of the jacket, is in an electrically conductive connection to a metallic shield, further comprising:

a metallic stopper pushed onto the jacket surrounding the circumference of the jacket and secured in position in a direction longitudinal to the cable; wherein the contact area of the shielding sheath is solderlessly clamped in between the stopper and the shield; and wherein the stopper sits in a close relationship to the shield about its entire circumference and the shield is held in a force-fit around the stopper in the longitudinal direction of the cable;

wherein the stopper comprises a conical circumferential surface onto which the shield is slipped to form a tight fit;

wherein the stopper comprises a web as a stop for an edge of the shield; and wherein the web is interrupted by recesses, through which lugs on the shield project, which lugs are bent and reach behind the stopper.

2. A coupling part according to claim 1, wherein the contact area is turned back onto the conical circumferential surface.

3. A coupling part according to claim 1, wherein the stopper comprises a collar which meets an end of the jacket in the longitudinal direction of the cable and around which the shielding sheath is led and pressed toward the cable.

4. A coupling part according to claim 1, wherein the stopper is firmly secured to the jacket by means of indentations.

5. A coupling part according to claim 1, wherein the stopper comprises a head portion and a neck portion which, relative to the head portion, has a thinner wall, wherein the shield is disposed at the head portion and wherein the neck portion projects beyond the shield in the longitudinal direction of the cable and is secured to the jacket by means of indentations.

* * * * *